US010371388B2

(12) United States Patent
Hofmann et al.

(10) Patent No.: US 10,371,388 B2
(45) Date of Patent: Aug. 6, 2019

(54) OVEN CAVITY AND OVEN

(71) Applicant: Electrolux Home Products Corporation N.V., Brussels (BE)

(72) Inventors: Arnd Hofmann, Rothenburg ob der Tauber (DE); Fabienne Reinhard-Herrscher, Rothenburg ob der Tauber (DE); Erhardt Koitzsch, Rothenburg ob der Tauber (DE)

(73) Assignee: Electrolux Home Products Corporation N.V., Brussels (BE)

( * ) Notice: Subject to any disclaimer, the term of this patent is extended or adjusted under 35 U.S.C. 154(b) by 280 days.

(21) Appl. No.: 14/355,023

(22) PCT Filed: Jan. 9, 2013

(86) PCT No.: PCT/EP2013/050258
§ 371 (c)(1),
(2) Date: Apr. 29, 2014

(87) PCT Pub. No.: WO2013/104644
PCT Pub. Date: Jul. 18, 2013

(65) Prior Publication Data

US 2014/0311473 A1 Oct. 23, 2014

(30) Foreign Application Priority Data

Jan. 13, 2012 (EP) ..... 12151023

(51) Int. Cl.
*F24C 15/08* (2006.01)

(52) U.S. Cl.
CPC ..... *F24C 15/08* (2013.01)

(58) Field of Classification Search
CPC ..... F24C 15/08
USPC ..... 126/19 R, 39 B, 369, 1 AA, 29
See application file for complete search history.

(56) References Cited

U.S. PATENT DOCUMENTS 1,593,718 A * 7/1926 Gehnrich ..... C23D 9/00 126/19 R
3,151,608 A * 10/1964 Hurko ..... F24C 15/007 126/19 R
3,452,183 A * 6/1969 Burger ..... F24C 14/02 219/406
3,920,944 A * 11/1975 Constable ..... A47J 37/0623 219/685

(Continued)

FOREIGN PATENT DOCUMENTS

DE 19900178 5/2000
EP 1106932 6/2001

(Continued)

OTHER PUBLICATIONS

International Search Report for PCT/EP2013/050258, dated Apr. 26, 2013, 3 pages.

*Primary Examiner* — Avinash A Savani
*Assistant Examiner* — Rabeeul I Zuberi
(74) *Attorney, Agent, or Firm* — Pearne & Gordon LLP

(57) ABSTRACT

The invention in particular is directed to an oven cavity (3) adapted to be used with a baking and/or steaming oven (1). The cavity (3) comprises several cavity walls (5, 6), wherein at least one load bearing wall section of at least one of the cavity walls (5, 6) is made in self-supporting configuration from at least one of a high temperature resistant polymer material and technical textile material.

21 Claims, 4 Drawing Sheets

(56) References Cited

U.S. PATENT DOCUMENTS

| | | | | | |
|---|---|---|---|---|---|
| 4,282,416 | A * | 8/1981 | White | H05B 6/6426 | 126/21 R |
| 4,313,043 | A * | 1/1982 | White | F24C 15/2042 | 126/299 D |
| 4,731,016 | A * | 3/1988 | Dixon | F26B 25/08 | 110/193 |
| 4,880,955 | A * | 11/1989 | Nitzinger | A21B 3/10 | 126/19 R |
| 5,596,450 | A | 1/1997 | Hannon et al. | | |
| 5,709,390 | A * | 1/1998 | Faccoli | F24C 15/021 | 277/637 |
| 6,337,143 | B1 * | 1/2002 | Ragland | A47L 15/4255 | 156/296 |
| 6,553,984 | B1 * | 4/2003 | Thomas | A47J 36/36 | 126/29 |
| 7,005,613 | B1 | 2/2006 | Spohn | | |
| 7,122,765 | B2 * | 10/2006 | Wong | A47J 36/20 | 219/391 |
| 2007/0290027 | A1 * | 12/2007 | Maatta | B65D 77/2024 | 229/123.1 |
| 2008/0145595 | A1 | 6/2008 | Pratt et al. | | |
| 2008/0149629 | A1 * | 6/2008 | Beausse | H05B 6/763 | 219/741 |
| 2009/0301460 | A1 * | 12/2009 | Schmidbauer | F24C 15/08 | 126/19 R |

FOREIGN PATENT DOCUMENTS

| | | | | |
|---|---|---|---|---|
| FR | 2040822 | A5 * | 1/1971 | F24C 15/007 |
| FR | 2783596 | | 3/2000 | |
| GB | 1013398 | A * | 12/1965 | F24C 15/021 |
| WO | WO9636197 | * | 11/1996 | H05B 3/00 |

* cited by examiner

OVEN CAVITY AND OVEN

The invention is directed to an oven cavity and an oven comprising such an oven cavity.

Oven cavities, in particular walls of oven cavities, of baking and/or steaming ovens, i. e. ovens adapted to apply heat radiation and/or hot steam to food products, conventionally are made from sheet-metal provided with an enamel coating. Reference is exemplarily made to DE 41 26 790 A1.

In connection with inductive heating elements, it has been proposed to use high quality steel, glassware, glass ceramic or ceramic materials for oven cavity walls. Reference is exemplarily made to DE 198 53 780 A1.

The referenced oven cavities or cavity walls require comparatively complex, complicate and costly manufacturing processes.

Therefore it would be desirable, and it is one of the aims of the present invention to provide oven cavities for baking and/or steaming ovens, in particular oven cavity walls, that can be manufactured in a comparatively easy and cost efficient way. Under similar aspects, an oven of baking and/or steaming type shall be provided.

These objects are solved according to the present invention by claims 1 and 9. Embodiments result from dependent claims.

According to claim 1, an oven cavity adapted to be used with an oven for baking and/or steaming based on a heating method selected from the group of resistance heating, infrared heating and induction heating is provided.

Baking and/or steaming shall mean that in particular food items, foodstuff and/or beverages can be processed by applying heat radiation and/or hot steam. Baking in its ordinary meaning shall not comprise applying microwave radiation to food items or similar substances.

The oven cavity as proposed comprises several cavity walls. A cavity wall may be one of a side wall, back wall, top wall, bottom wall or any combination or combination of parts thereof.

The term cavity wall shall in particular comprise shells, each of which comprising at least two sections of a side, bottom, top and back wall in a one-piece configuration. A shell may for example comprise a side wall and one half of a top wall and one half of a bottom wall. Also it is possible that a shell comprises a top or bottom wall and respectively one half of a left and right side wall. Such half shells may be set together to make up in the end side, top and bottom walls.

With the proposed oven cavity, at least a load bearing wall section of at least one of the cavity walls is made in self-supporting configuration from at least one of a high temperature resistant polymer material and technical textile material.

The high temperature resistant polymer material may for example be at least one of a liquid crystal polymer (LCP) and polyphenylene sulfide (PPS) polymer material. Other similar materials, in particular polymer materials, having similar high melting points, may be used as well. For example, PEEK (polyether ether ketone) may be used. Further, reinforced, in particular glass fiber reinforced, polymer materials, such as for example PET-GF20 (polyethylene terephthalate with 20% glass fibers) or similar, may be used. Reinforcement materials may increase the overall melting point. Regarding technical textile materials, woven glass fiber structures and elements may be used.

The term "load bearing" shall mean that the wall section has load bearing properties or functions with respect to the related wall or even the whole oven cavity. This in turn implies that the respective section is not just provided as an additional non-load bearing element attached to or implemented with a cavity wall.

The term "at least one load bearing wall section of at least one cavity wall" in particular shall mean, that one or more parts of a single or several cavity walls, a whole wall, several interconnected walls or wall sections may be made from at least one of a high temperature resistant polymer material and high temperature technical textile material. In general, a cavity wall may be a side wall, back wall, top wall or bottom wall or any combinations or partial combinations thereof.

In more general and simple words, the invention proposes an oven cavity where one or several cavity walls at least in load bearing sections are made from at least one of a high temperature resistant polymer material and technical textile material. This in particular shall include that a whole wall, whole walls and even the whole cavity, i. e. all cavity walls, are made from at least one of a high temperature resistant polymer material and technical textile material. The oven cavity may be set together from several interconnected cavity walls of wall sections. However, it also shall be possible that the whole cavity is made as a single part from respective materials.

The term "shelf-supporting" shall mean that the respective wall section of the at least one cavity wall is stable enough to implement a load bearing function, in particular without any reinforcement or stiffening elements.

The term "high temperature", relating to the polymer material and technical textile material shall mean that respective materials withstand operational conditions requiring 200° C. or more, in particular 250° C.

The proposed oven cavity, in particular the at least one load bearing wall section, can be manufactured by casting, deep-drawing and/or injection compression molding. If required, sub-sequent laser welding and/or mirror welding may be used for shaping and/or processing respective wall sections.

One advantage of the proposed materials, i. e. polymer materials and/or technical textiles, is that they are not liable to corrosion which is one great advantage as compared to conventional cavity walls made from sheet metal. Note that corrosion is one major issue in particular with steaming ovens.

One further advantage is that the heat conductivity of the proposed materials is far lower than that of conventional metal sheets. Beyond that, oven cavities comprising the proposed materials have reduced weight as compared to metals. Both facts, i. e. reduced heat conductivity and reduced weight, contribute to reduce energy loss and therefore help to improve energy efficiency.

In one preferred embodiment, the at least one wall section comprises at least one functional element which is implemented in one-piece, preferably monolithic, configuration with the at least one wall section. The term "functional element" shall in particular mean that a mechanical and/or electrical connection with and to a counterpart element, component or unit of the oven can and is to be established upon ordinary assembly of the oven. This means that the functional element, which may be a designed as a functional interface, is adapted to interact and be coupled with a corresponding functional component of the oven.

Providing such a functional element in a one-piece configuration is of particular advantage with respect to cost efficient manufacture and assembly of the oven.

The at least one functional element may be at least one of an outer fastening element for fastening the oven cavity to a supporting structure of the oven, an air channel for feeding and/or discharging air and/or steam to/from the oven cavity, a door gasket, an interconnection gasket, a component of a steam generation unit, a thermal insulation and other or similar elements.

An outer fastening element may be provided in order to attach the cavity to a mounting frame or corresponding counter part mounting element of the oven. The fastening element may be made from a polymer material, equal or similar to that of the wall section. Preferably, the fastening element is made from a polymer allowing elastic deformation and hence elastic shock absorption.

An air channel as a functional element may be provided for the purpose of feeding and/or discharging air and/or steam to/from the cavity. Implementing air channels in walls or sections thereof may lead to less constructional and manufactural efforts.

Providing a door gasket as a functional element implemented in a one-piece configuration is of particular advantage if side walls, bottom wall and top wall are made from the polymer material at least in sections facing and adjacent to a cavity opening to be closed by a door. The door gasket may be made from a material similar to that of the wall section, preferably being yet more elastic than that of the wall section.

The functional element may as well be implemented as an interconnection gasket. An interconnection gasket in the sense of the present invention shall be a gasket provided and adapted to interconnect adjacent wall sections, walls or parts of the oven cavity walls. For example, top, bottom, side and back walls or half shells comprising at least sections thereof may be interconnected by respective interconnection gaskets.

The functional element may also be a component of a steam generation unit, for example if the oven is or will be provided with a steaming functionality. A respective component may for example be a steam tank and/or steam tubing.

A further functional element may be a thermal insulation provided at on outer side of the wall section. The wall section and thermal insulation may be molded together in one piece. This greatly simplifies assembly of the oven, and in the end may lead to reduced manufacturing costs.

Beyond that, further functional elements may be provided in a one-piece monolithic configuration, such as for example support and guiding elements adapted to support and guide trays, in particular baking trays, or baking grids to be inserted into the oven cavity. Support and guiding elements may be provided at side walls of the oven cavity, in particular in the form of elongated recesses running in a front to back direction.

In a specific embodiment, the interconnection gasket comprises at least one first form-fit element adapted to establish a form-fit connection, i. e. tight fit connection, to at least one second form-fit element of at least a section of an adjacent cavity wall. The form-fit elements may be adapted and designed such that the form-fit connection is automatically established upon plugging the first and second form-fit element together.

Preferably, the form-fit elements, however at least one of the form-fit elements, are made from an elastic material, such as high-temperature silicone, in particular elastic plastic material, such that the form-fit elements are held together by elastic forces generated and exerted upon and after plugging the form-fit elements together.

As an example, the form-fit connection may be a tongue and groove type connection, where one of the form-fit elements acts as and comprises a groove and the other form-fit element acts as and comprises a tongue to be inserted into the groove. The groove and/or tongue may be designed such that the tongue is held within the groove by elastic forces, which in particular is the case if parts of the groove are made from elastic material.

Preferably the form-fit connection is sufficiently fluid and air tight. Therefore, the form-fit connection may in particular comprise a seal, i. e. gasket. The seal may for example be placed within the groove such that the tongue is pressed against the seal, preferably by elastic forces exerted by the groove. The seal may in particular be adapted such that the form-fit connection in the end blocks passage of air and steam, vapor and moisture, i. e. water, generated within the oven cavity during operation.

In a further advantageous embodiment, the at least one wall section comprises an embedded electrical component. The electrical component may be at least one of a wiring structure and embedded illumination element, such as light sources and/or light guides, such as optical fibers for example. Also, electronic components may be eligible for being embedded. Embedding electrical and/or electronic components may be useful for protecting respective components from outer impacts, such as moisture, vapor and steam. Further, embedding respective components may help to reduce expenditure in manufacturing and mounting the oven.

In a further embodiment of the oven cavity an inner side of the at least one wall section is furnished with a heat barrier of heat reflective material. The term "inner side" shall mean a side facing the interior of the completed oven cavity. As a heat barrier of heat reflective material, metal, in particular aluminum, laminate, in particular bars or strips made from metal, in particular aluminum, laminate may be used. Other possibilities for realizing heat barriers are reflective coatings on the non-metallic carrier. Such coatings may be applied by vapor deposition and/or impregnation, in particular soaking and/or spray impregnation.

The heat barrier may have a thickness of about 50 μm to 5 mm, preferably 0.35 mm, and may cover 5% to 100% of the inner face of a respective the wall section. The heat barrier may provide some kind of protection against overheat. However, as the heat barrier is heat reflective, energy loss through the cavity walls can be reduced and energy efficiency may thus be increased.

In a further embodiment, the inner side or face of the at least one wall section is furnished with an easy-to-clean structure, based for example on the well known lotus-effect. The easy to clean structure may be implemented as a special surface topology of the wall section and/or in a separate coating.

In a further embodiment, a structure for baking trays or baking grids or the like is at least partially, preferably completely, integrated in at least one of the cavity walls made of at least one of high temperature resistant polymer material and technical textile material and/or wherein the oven cavity is completely integrally made of at least one high temperature resistant polymer material and technical textile material. An integrated structure for food supporting trays or the like is easy to clean. In particular in a cavity which is made integrally from polymers, gaps or slots or the like can be avoided wherein otherwise filth, fat or residues of food to be cooked can accumulate. Thus, such an embodiment has improved hygienic properties.

According to claim 10, an oven of baking and/or steaming type is provided, with a heating method being selected from the group of resistance heating, infrared heating and induction heating, the oven comprising an oven cavity according to the proposed oven cavity, including any embodiment described further above and below. As to advantages and advantageous effects of the oven, reference is made to the description above and below.

Exemplary embodiments will now be described in connection with the annexed figures, in which FIG. 1 shows a front view of a baking and steaming oven;

In the figures, like elements will be designated with like reference signs, as far as not otherwise stated. It shall be mentioned, that the figures relate to exemplary embodiments and elements shown alone or in combinations may instead be provided in any other combination or alone at least as far as set out further above and below.

Figure 1:
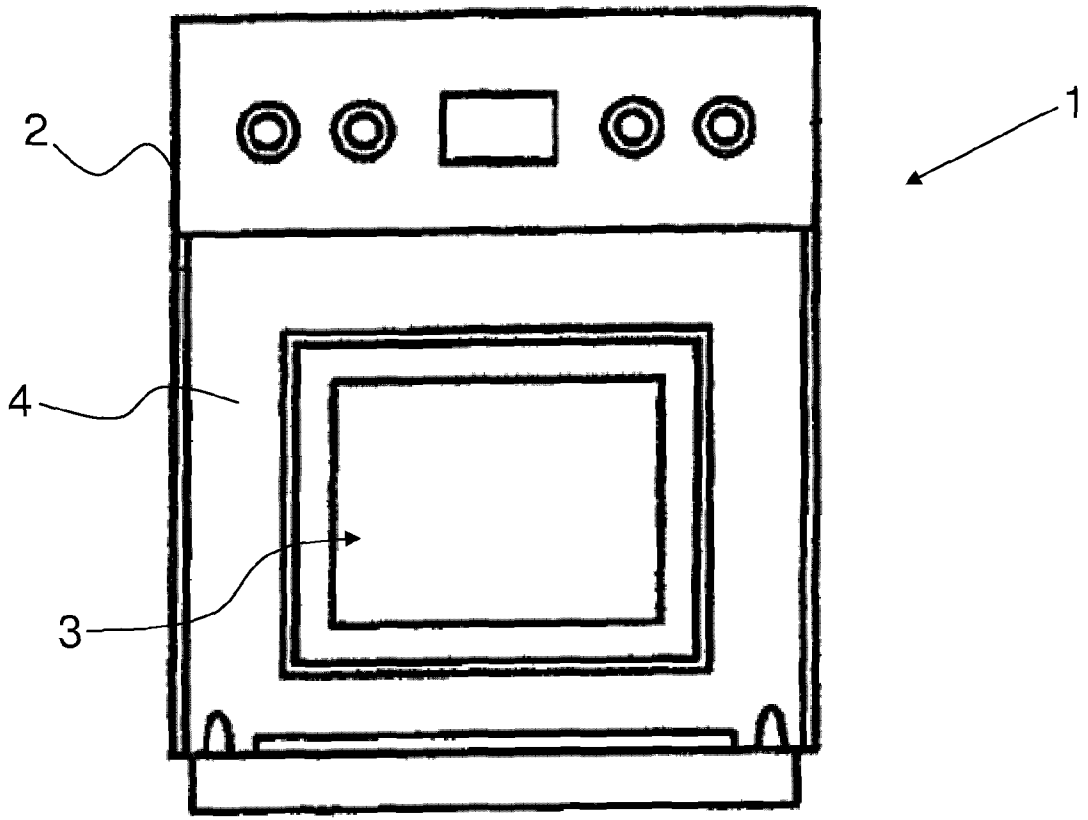

FIG. 1 shows a front view of a baking and steaming oven 1, which will be designated in short by "oven" in the following. The oven 1 comprises an outer housing 2 in which an oven cavity 3 for accommodating trays or grates with food or beverages to be heated is mounted. During operation of the oven 1, the cavity 3 is closed by front door 4, which is hinged to the outer housing 2 or a supporting structure of the oven 1.

Figure 2:
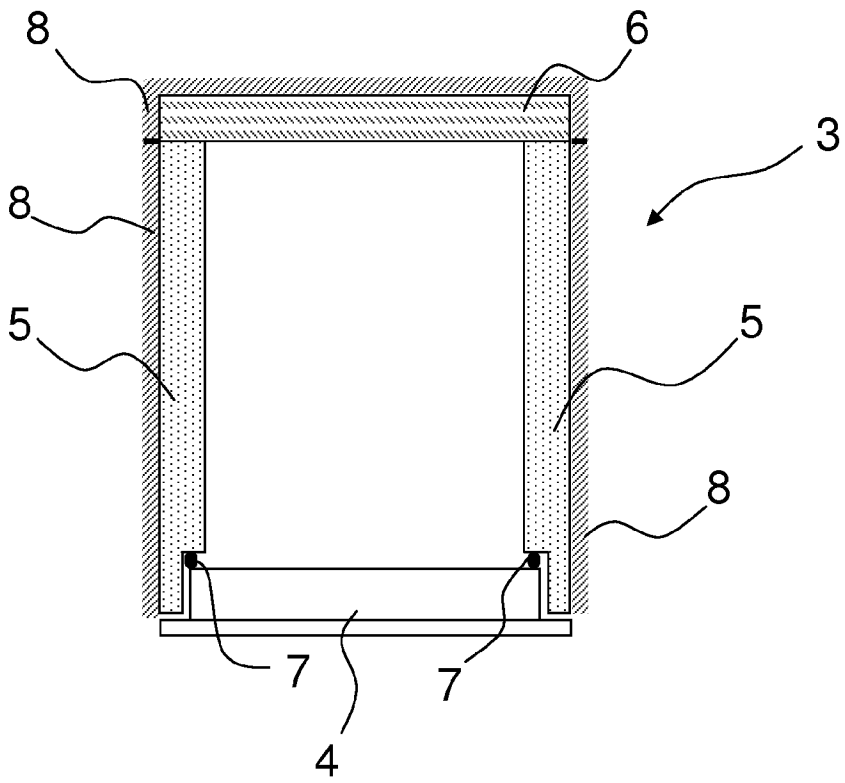
FIG. 2 shows a horizontal cross sectional view of an oven cavity.

FIG. 2 shows a horizontal cross section of an oven cavity 3. The oven cavity 3 comprises, as far as visible from FIG. 2, two side walls 5 and a back wall 6. The two side walls 5 in the present case both are as a whole made from a high temperature resistant polymer material, in particular LCP or PPS. The back wall 6 in the present case is made from a high temperature resistant technical textile material, in particular a material containing woven glass fibers and the like.

The side walls 5 and the back wall 6 are bonded together in an air and vapor tight manner. Mirror welding and/or gluing are examples for bonding together respective wall sections. Tight connections can be obtained in particular by providing the side walls 5 and back wall 6 at adjacent face sides with corresponding interconnection gaskets (not explicitly shown in FIG. 2). The interconnection gaskets may be implemented in a one-piece configuration, i. e. they may be fixedly connected to the respective wall. The interconnection gasket may be made from a plastic material, if appropriate an elastic plastic material. As far as a respective wall is made from plastic, the interconnection gasket may be implemented in monolithic configuration with the wall.

Note that it would be possible that only a section or part of a respective side wall 5/back wall 6 is made from the polymer material/textile material. Further, it would be possible that one or both side walls 5 are made from a technical textile material and/or that the back wall 6 is made from respective polymers.

At face sides of the side walls 5 distant from the back wall 6, there are provided step like recesses, adapted to accommodate respective edges of the front door 4. At respective face sides, the side walls 5 further comprise a door gasket 7. In the closed state, the front door 4 is urged against the door gasket 7 to more or less tightly close the oven cavity 3. The door gasket 7 may be implemented as a one-piece part with the side walls. Preferably, an elastic and sufficiently flexible plastic material, such as for example a high-temperature silicone material, is used for the door gasket 7.

It shall be mentioned that top and bottom wall (not shown in FIG. 2) of the cavity 3 may be made from the high temperature polymer material and/or technical textile material. Joints and interconnection gaskets between top wall and side walls and back wall and between bottom wall and side walls and back wall may be provided to tightly connect adjacent walls to obtain a cavity 3 in the end being essentially impermeable for air, steam, vapor and water.

The side walls 5 and back wall 6 respectively further comprise an outer insulation layer 8, acting as a thermal insulation of the cavity 3 towards the outside. The insulation layers 8 are bonded together at intersections between side walls 5 and back wall 6. At least the insulation layer 8 of the side walls is implemented in a one-piece configuration with the respective side walls 5. This in particular means that the side walls 5 together with the insulation layer can be handled and mounted as one piece.

Figure 3:
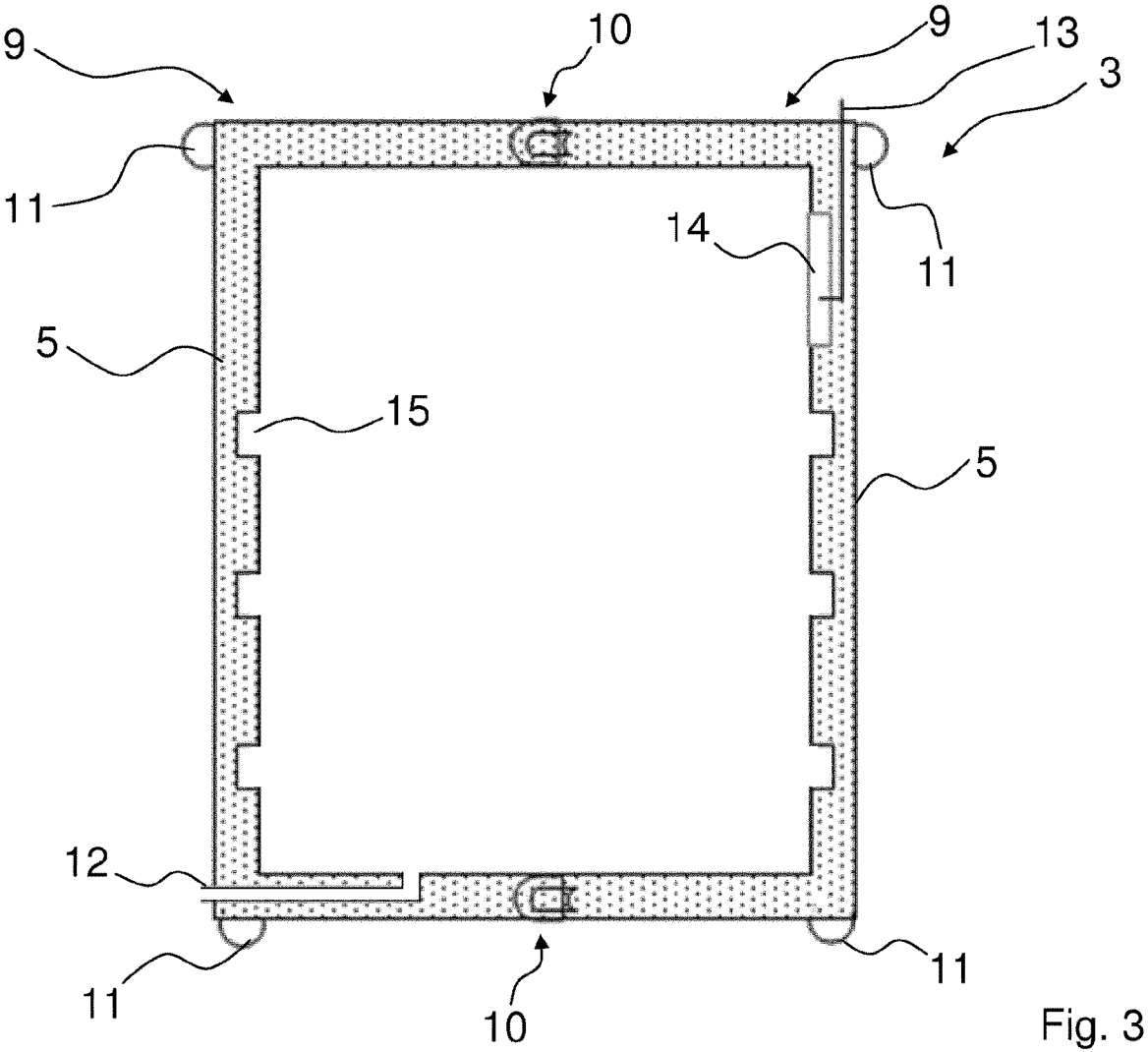
FIG. 3 shows a vertical cross sectional view of an oven cavity.

FIG. 3 shows a vertical cross sectional view of an oven cavity 3, which in some details differs from that of FIG. 2. Note that single or groups of elements mentioned in connection with FIG. 2 and not shown with the cavity in FIG. 3 may be implemented with the cavity of FIG. 3, and vice-versa.

The oven cavity 3 shown in FIG. 3 differs from that of FIG. 2 in that it comprises two c-shaped half-shells 9 respectively constituting a side wall 5 and appropriately one half of a top and bottom wall. Note that the c-shaped configuration may also be implemented such that a half-shell comprises a top or bottom wall and appropriately one half of respective side walls 5, i. e. of respective right and left hand side walls 5. The half shells 9 are made from at least one of a high temperature resistant polymer material and technical textile material.

The two c-shaped half-shells 9 are interconnected via two interconnection gaskets 10. One of the interconnection gaskets 10 is provided in the top wall of the oven cavity 3 and the other one is provided in the bottom wall of the oven cavity 3.

The interconnection gasket 10 is implemented as form-fit connection, comprising a tongue and groove like design. Components of the interconnection gaskets 10 may be made from elastic materials, in particular high-temperature silicones and/or high-temperature resistant polymers, in particular in shape of spring-like form fitting clips, such that male and female components are held together by elastic forces. Preferably, additional sealing elements are provided to obtain a sufficiently tight seal. An exemplary form-fit connection will be described in connection with FIG. 4.

The two half-shells 9 comprise several functional elements that will subsequently be described in more detail.

One functional element may be a thermal insulation as shown and described only in connection with FIG. 2. The door gasket 7 and interconnection gasket 10 also constitute functional elements that may be implemented in a one-piece configuration. Further functional elements may be provided as door gaskets 7, The oven cavity 3 in FIG. 3 comprises as additional functional elements outer fastening elements 11. The outer fastening elements 11 are adapted to mount the cavity 3 to a supporting structure or frame of the oven 1. In order to obtain favorable shock absorption properties, it is preferred that the outer fastening elements 11 be made from materials, in particular plastic materials, allowing elastic deformation. Further, outer fastening elements 11 are preferably made from materials of low thermal conductivity, in particular ceramics and high-temperature polymers, such that thermal loss can be kept low.

As a further functional element, the half shells 9 comprise an air channel 12, schematically and exemplarily shown as a bottom air channel. The air channel 12, which may be provided at any other location of the cavity 3, in particular the cavity walls or half-shells 9, is presently implemented as an inner duct. Note that the air channel 12 may also be implemented as an outer or inner duct running at an outer or inner side of a respective section of the cavity 3. As is the case with FIG. 3, the air channel 12 is implemented in a one-piece configuration with respective cavity walls or wall sections. The air channel 12 may be used to feed and/or discharge air and/or steam to/from the cavity 3.

The oven cavity 3 of FIG. 3 further comprises an embedded wiring 13. The wiring 13 embedded in a respective section of a cavity half shell 9 is shielded against outer impacts, such as moisture and the like, by the surrounding plastic/polymer and/or textile material.

In the present case, the wiring 13 is part of an electrical connection of an illumination element 14 adapted to illuminate the interior of the oven cavity 3. The illumination element 14 is implemented within a respective wall section, wherein light sources (not shown), such as LED and/or OLED elements, are integrated in a section of the respective cavity wall. In order to admit light propagation into the cavity 3, an inner cover which may be part of the cavity wall itself may be made from a transparent plastic material and/or glass. Note that the position and/or number of illumination elements 14 may be adapted according to respective needs.

The oven cavity shown in FIG. 3 comprises as additional functional elements supports 15 adapted to support baking trays or grates. The supports 15 in the present case are implemented as elongated recesses, presently in rectangular cross section, running from front to back. Other configurations are conceivable.

Figure 4:
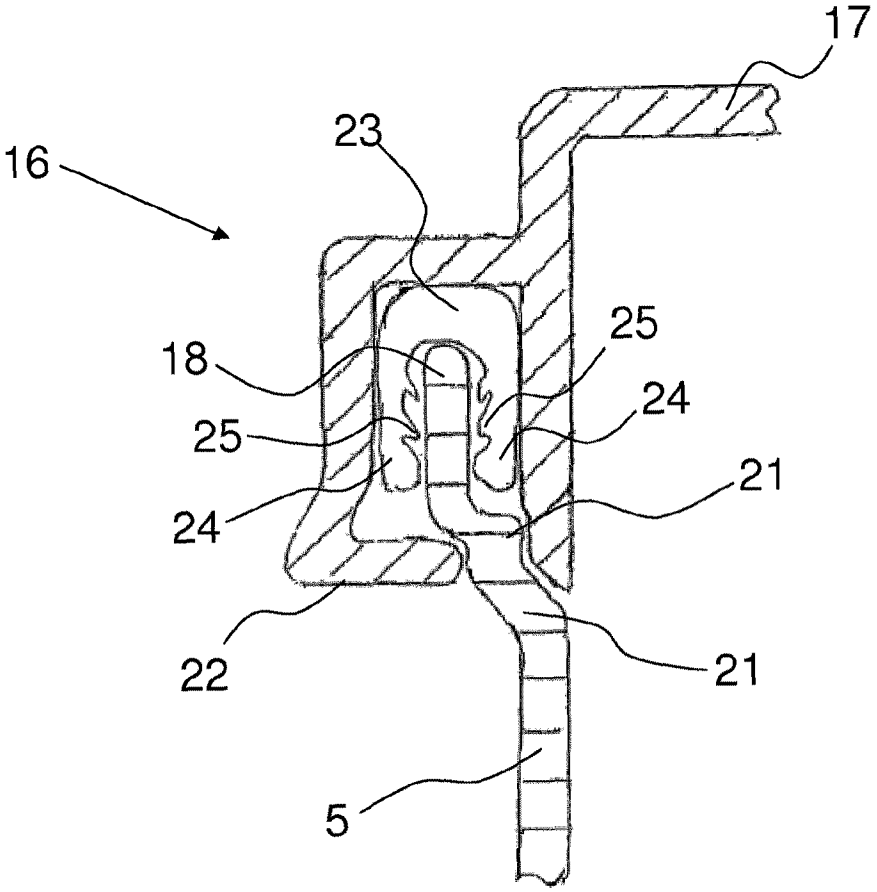
FIG. 4 shows an enlarged view of a form-fit connection between cavity walls.

FIG. 4 shows an enlarged view of a form-fit connection 16 between adjacent cavity walls, which form-fit connection 16 makes up an interconnection gasket. The form-fit connection 16 as shown in FIG. 4 is implemented as an interconnection gasket between a side wall 5 and a top wall 17.

Interconnection gaskets, in particular form-fit elements 16 may be provided between any adjacent wall sections of the cavity 3. In this respect it shall be mentioned that the cavity 3 may comprise two side, a top and a bottom wall implemented as separate walls. It is also possible that the cavity comprises two half-shells, which may be designed according to FIG. 3, i. e. respectively comprise a side wall and a part of a top and bottom wall. In a different configuration, it is possible that a half-shell comprises a top or bottom wall and respectively a part of a left and right side wall.

The fit-form connection 16 makes up a groove and tongue type connection. A tongue-like projection 18 extends at a face side of the side wall 5. Further, a groove-shaped head piece 19 is provided as an extension of the top wall 17, presently angled downwards by about 90 degrees relative to the top wall 17.

The head piece 19 comprises two limbs 20 at least partially encompassing the tongue-like projection 18. A form-fit connection between the tongue-like projection 18 and the head piece 19 in particular is obtained by first shoulders 21 and a second shoulder 22 provided at the tongue-like projection 18 and the head piece 19, respectively. The first 21 and second shoulders 22 are designed such that a tight connection, in particular an air and fluid tight connection, between adjacent cavity walls can be established.

The head piece 19, in particular the limbs 20, and the tongue-like projection 18, at least in the region of the first shoulders 21, are preferably made from an elastic plastic material.

Further, a sealing element 23 is provided, presently accommodated in a groove established by the head piece 19. The sealing element 23 is designed in a u-shaped configuration, comprising two sealing wings 24. The sealing wings 24 fit against lateral, opposite sides of the tongue-like projection 18. In more detail, the sealing wings 24 comprise on inner walls facing each other elastic barb-type sealing lips 25 adapted to fit against the tongue-like projection 18 when the latter is inserted into the u-shaped sealing element 23. In particular via the sealing lips 25 an air and fluid tight, in particular steam tight, seal between adjacent cavity walls can be established.

Just for sake of completeness, it shall be mentioned that inner sides of a cavity wall or sections thereof, made from a high temperature resistant polymer and/or technical textile material may be furnished with a heat barrier or heat barrier elements. The heat barrier elements preferably are made from a heat reflective material. In an embodiment, the heat barrier elements may be implemented as metal strips, in particular aluminum strips, connected to the respective wall or wall section. The heat barrier elements may be fixed to the wall or wall section by adhesives, welding, or they may be molded together with the respective wall or wall section. As far as metal strips are used, they may have a thickness of about 0.5 mm.

Further it shall be mentioned that at least parts of inner sides of walls or wall sections made from a high temperature resistant polymer and/or technical textile material may be furnished with an easy-to-clean structure. Such an easy-to-clean structure may be applied as a coating. It is also conceivable that the easy-to-clean structure is established by the surface topology of the respective wall or wall section.

The surface topology may be obtained by using suitable moulds for manufacturing the wall or wall section.

As will readily be recognized, the proposed oven cavity and baking and/or steaming oven are well suitable for solving the underlying problems.

LIST OF REFERENCE NUMERALS

1 oven
2 outer housing
3 cavity
4 front door
5 side wall
6 back wall
7 door gasket
8 insulation layer
9 half-shell
10 interconnection gasket
11 outer fastening element
12 air channel
13 wiring
14 illumination element
15 support
16 form-fit connection
17 top wall
18 tongue-like projection
19 head piece
20 limb
21 first shoulder
22 second shoulder
23 sealing element
24 sealing wing
25 sealing lip

The invention claimed is:

1. Oven cavity adapted to be used with an oven for baking and/or steaming based on a heating method selected from the group of resistance heating, infrared heating and induction heating, comprising several cavity walls, wherein at least a load bearing wall section of at least one of the cavity walls as a whole is made in self-supporting configuration from at least one of a high temperature resistant polymer material and technical textile material, wherein the at least one load bearing wall section comprises in a one-piece, monolithic configuration at least one functional element adapted to interact and be coupled with a corresponding functional component of the baking and/or steaming oven, wherein the at least one functional element comprises at least one of: a) an outer fastening element adapted to mount the oven cavity to a supporting structure or frame of the oven and b) supports adapted to support baking trays or grates.

2. Oven cavity according to claim 1, further comprising at least one additional functional element formed in a one-piece, monolithic configuration with a wall section comprised within said at least one load-bearing wall section, said additional functional element comprising at least one of an outer fastening element for fastening the oven cavity to a supporting structure of the oven, an air channel for feeding and/or discharging air and/or steam to/from the oven cavity, a door gasket, an interconnection gasket, a component of a steam generation unit, a thermal insulation, and supports adapted to support baking trays or grates.

3. Oven cavity according to claim 2, wherein the interconnection gasket comprises at least one first form-fit element adapted to establish a form-fit connection to at least one second form-fit element of at least a section of an adjacent cavity wall.

4. Oven cavity according to claim 3, wherein the form-fit elements are of tongue and groove type configuration, and an additional sealing element is provided within a groove of the tongue and groove type form-fit elements.

5. Oven cavity according to claim 1, wherein the at least one wall section comprises as an embedded electrical component, at least one of a wiring structure and embedded illumination elements.

6. Oven cavity according to claim 1, wherein an inner side of the at least one wall section is furnished with a heat barrier of heat reflective material.

7. Oven cavity according to claim 1, wherein an inner side of the at least one wall section is furnished with an easy-to-clean structure.

8. Oven cavity according to claim 1, wherein a structure for baking trays or baking grids or the like is at least partially integrated in at least one of the cavity walls made of at least one of high temperature resistant polymer material and technical textile material.

9. Oven for baking and/or steaming based on a heating method selected from the group of resistance heating, infrared heating and induction heating, comprising an oven cavity according to claim 1.

10. Oven cavity according to claim 8, wherein the structure for baking trays or baking grids or the like is completely integrated in at least one of the cavity walls made of at least one of high temperature resistant polymer material and technical textile material.

11. Oven cavity adapted to be used with an oven for baking and/or steaming based on a heating method selected from the group of resistance heating, infrared heating and induction heating, comprising several cavity walls, comprising two c-shaped half-shells that respectively constitute a side wall and appropriately one half of a top wall and a bottom wall of the oven cavity, wherein at least a load bearing wall section of at least one of the cavity walls as a whole is made in self-supporting configuration from at least one of a high temperature resistant polymer material and technical textile material, wherein the at least one load bearing wall section comprises in a one-piece, monolithic configuration at least one functional element adapted to interact and be coupled with a corresponding functional component of the baking and/or steaming oven.

12. Oven cavity according to claim 11, said at least one load bearing wall section comprising said side walls, wherein the two c-shaped half-shells are interconnected via an interconnection gasket implemented as a form-fit connection.

13. Oven cavity according to claim 12, the interconnection gasket comprising a tongue and groove-like design, at least one of which is formed of elastic high-temperature silicone and/or of elastic high-temperature resistant polymer.

14. Oven cavity according to claim 13, said tongue and groove-like design being in the shape of spring-like form fitting clips such that male and female components of said clips are held together by elastic forces.

15. Oven cavity according to claim 2, said at least one additional functional element comprising a door gasket made of a high-temperature silicone.

16. Oven cavity according to claim 15, wherein a face side of said wall section comprises a step-like recess adapted to accommodate a respective edge of a door of said oven cavity.

17. Oven cavity according to claim 2, said at least one additional functional element comprising an outer insulation layer.

18. Oven cavity according to claim 1, said at least one functional element comprising supports adapted to support baking trays or grates.

19. Oven cavity according to claim 18, said supports being implemented as elongated recesses running front to back in the respective side walls.

20. Oven cavity according to claim 1, said at least one functional element comprising an outer fastening element being adapted to mount the oven cavity to a supporting structure or frame of an oven.

21. Oven cavity according to claim 20, said outer fastening element being made from a ceramic or high-temperature polymer material that allows plastic deformation and which has low thermal conductivity.

* * * * *